US007843256B2

(12) United States Patent
Do

(10) Patent No.: US 7,843,256 B2
(45) Date of Patent: Nov. 30, 2010

(54) INTERNAL VOLTAGE GENERATOR

(75) Inventor: Chang-Ho Do, Kyoungki-do (KR)

(73) Assignee: Hynix Semiconductor Inc., Gyeonggi-do (KR)

( * ) Notice: Subject to any disclaimer, the term of this patent is extended or adjusted under 35 U.S.C. 154(b) by 0 days.

(21) Appl. No.: 12/479,055

(22) Filed: Jun. 5, 2009

(65) Prior Publication Data

US 2009/0237152 A1 Sep. 24, 2009

Related U.S. Application Data

(62) Division of application No. 11/529,253, filed on Sep. 29, 2006, now abandoned.

(30) Foreign Application Priority Data

Sep. 29, 2005 (KR) ..... 2005-0091678
Dec. 29, 2005 (KR) ..... 2005-0133959

(51) Int. Cl.
*G05F 1/575* (2006.01)

(52) U.S. Cl. ..... 327/540; 327/543; 327/546; 363/74

(58) Field of Classification Search ..... None
See application file for complete search history.

(56) References Cited

U.S. PATENT DOCUMENTS 6,281,665 B1 * 8/2001 Miyaba et al. ..... 323/224
6,339,318 B1 * 1/2002 Tanaka ..... 323/313
6,600,692 B2 * 7/2003 Tanzawa ..... 365/226

* cited by examiner

*Primary Examiner*—Lincoln Donovan
*Assistant Examiner*—Terry L Englund
(74) *Attorney, Agent, or Firm*—IP & T Group LLP

(57) ABSTRACT

An internal voltage generator includes a pull-up driver to pull-up drive a supply terminal of an internal voltage, a pull-down driver to pull-down drive the supply terminal of the internal voltage, a pull-up driving control unit to turn on the pull-up driver when a first feedback voltage corresponding to the internal voltage becomes lower than a reference voltage, and a pull-down driving control unit to turn on the pull-down driver when a second feedback voltage becomes higher than the reference voltage, the second feedback voltage having a voltage level corresponding to that of the internal voltage and lower than that of the first feedback voltage.

16 Claims, 9 Drawing Sheets

INTERNAL VOLTAGE GENERATOR

PRIORITY

This application is a division of now abandoned U.S. patent application Ser. No. 11/529,253 filed on Sep. 29, 2006, which claims priority of Korean patent application number 2005-0091678 filed on Sep. 29, 2005 and Korean patent application number 2005-0133959 filed on Dec. 29, 2005. The disclosure of each of the foregoing applications is incorporated herein by reference in its entirety.

FIELD OF THE INVENTION

The present invention relates to a semiconductor device fabrication technology, and more particularly, to an internal voltage generator.

DESCRIPTION OF RELATED ARTS

A supply voltage of a semiconductor memory device has decreased, and thus, various technologies have been introduced to obtain stable memory operation characteristics. Various types of internal voltage supplying devices using a double voltage down converter have been developed into a form of technology.

Meanwhile, an internal voltage sometimes ascends excessively higher than a desired value due to response characteristics of pull-up and pull-down drivers in a generally used internal voltage supplying device or due to differences in circuit configurations and operational environments. Various defects may result because of the unstable internal voltage. Especially, defects related to changes of the internal voltage react sensitively to the operational environments, and thus, it is difficult to secure a stable operation performance.

Therefore, an internal voltage generator including a block which obtains a desired value by discharging the ascended voltage is examined in more detail.

FIG. 1 is a circuit diagram of a typical internal voltage generator. The typical internal voltage generator includes a pull-up driver PM1 for pull-up driving a supply terminal of an internal voltage VINT, a pull-down driver NM1 for pull-down driving the supply terminal of an internal voltage VINT, a pull-up control unit 10 for turning on the pull-up driver PM1 when a level of the internal voltage VINT is lower than that of a reference voltage VR, and a pull-down control unit 20 for turning on the pull-down driver NM1 when the level of the internal voltage VINT is higher than that of a reference voltage VR.

The pull-up control unit 10 includes a first feedback unit 12 for generating a first feedback voltage Vfd1 having a uniform voltage level with respect to the level of the internal voltage VINT and a first control signal generating unit 14 for generating a pull-up driving signal DRV_ONB by comparing the reference voltage VR and the first feedback voltage Vfd1.

The first feedback unit 12 includes an active resistor formed by metal oxide semiconductor (MOS) transistors coupled in series between the supply terminal of the internal voltage VINT and a supply terminal of a ground voltage VSS. The outputted first feedback voltage Vfd1 has an approximately half voltage level of the internal voltage VINT.

The first control signal generating unit 14 includes a first comparator which compares a voltage level difference between the first feedback voltage Vfd1 and the reference voltage VR. The first comparator enables the pull-up driving signal DRV_ONB into a logic level low (L) when the level of the first feedback voltage Vfd1 is lower than that of the reference voltage VR.

The pull-down control unit 20 includes a second feedback unit 22 for generating a second feedback voltage Vfd2 having a uniform voltage level with respect to the level of the internal voltage VINT and a second control signal generating unit 24 for generating a pull-down driving signal DIS_ON by comparing the reference voltage VR and the second feedback voltage Vfd2 in response to a driving off signal DIS_ENB.

The second feedback unit 22 includes an active resistor formed by MOS transistors coupled in series between the supply terminal of the internal voltage VINT and the supply terminal of the ground voltage VSS. Such outputted second feedback voltage Vfd2 has an approximately half voltage level of the internal voltage VINT. Thus, the second feedback voltage Vfd2 has substantially the same level as that of the first feedback voltage Vfd1.

The second control signal generating unit 24 includes a second comparator 24A and an off unit NM2. The second comparator 24A compares a voltage level difference between the second feedback voltage Vfd2 and the reference voltage VR when the driving off signal DIS_ENB is disabled. When the level of the second feedback voltage Vfd2 is higher than that of the reference voltage VR, the second comparator 24A enables the pull-down driving signal DIS_ON into a logic level high (H). The off unit NM2 disables the pull-down driving signal DIS_ON into a logic level L when the driving off signal DIS_ENB is enabled.

The off unit NM2 includes an NMOS transistor receiving the driving off signal DIS_ENB through its gate and having a drain-source channel between an output node of the second comparator 24A and the supply terminal of the ground voltage VSS.

FIG. 2 is a waveform diagram of operations of the typical internal voltage generator shown in FIG. 1. When a large consumption of the internal voltage VINT occurs due to read or write operations, an actual value of the internal voltage VINT_ACTUAL VALUE descends below a desired value VINT_DESIRED VALUE.

Accordingly, a level of the first feedback voltage Vfd1 generated by the first feedback unit 12 also descends below the reference voltage VR. Thus, the first comparator 14 enables the pull-up driving signal DRV_ONB into the logic level 'L'. Therefore, the pull-up driver PM1 is enabled and supplies the internal voltage VINT, ascending the actual value of the internal voltage VINT_ACTUAL VALUE.

When the actual value of the internal voltage VINT_ACTUAL VALUE descends below the desired value VINT_DESIRED VALUE, the pull-up control unit 10 and the pull-driver PM1 are enabled to supply the internal voltage VINT. As the result, the actual value of the internal voltage VINT_ACTUAL VALUE ascends above the desired value VINT_DESIRED VALUE.

When the actual value of the internal voltage VINT_ACTUAL VALUE ascends higher than the desired value VINT_DESIRED VALUE, a level of the second feedback voltage Vfd2 generated by the second feedback unit 22 ascends higher than that of the reference voltage VR.

The second comparator 24A senses the second feedback voltage Vfd2 ascending higher than the reference voltage VR when the driving off signal DIS_ENB is disabled, and enables the pull-down driving signal DIS_ON into the logic level 'H' Thus, the pull-down driver NM1 is enabled to pull-down drive the supply terminal of the internal voltage VINT, keeping the actual value of the internal voltage VINT_ACTUAL VALUE from ascending higher than the desired value VINT_DESIRED VALUE.

The actual value of the internal voltage VINT_ACTUAL VALUE is maintained to correspond to the desired value VINT_DESIRED VALUE by repeating the above processes. However, response characteristics of the first comparator 14 and the second comparator 24A are different, and loadings of the pull-down driving signal DIS_ON and the pull-up driving signal DRV_ONB are also different. Thus, the first comparator 14 and the second comparator 24A have different delay times and slopes with respect to succession characteristics.

Environments of each of the pull-up and pull-down drivers PM1 and NM1 and each of the feedback units 12 and 22 are different. Even if the environments are the same, a period where both of the pull-up driver PM1 and the pull-down driver NM1 are simultaneously turned on is generated when the pull-up driver PM1 and the pull-down driver NM1 switch. In this case, a consumption of a direct current Idirect occurs between the pull-down driver PM1 and the pull-up driver NM1, and thus, it creates an overall increase in current consumption, and leads to deterioration of the product competitiveness.

In such cases, the operation of the second comparator is often delayed to operate the pull-down driver, avoiding times of high internal voltage usage. However, the generation of the period where both of the pull-up driver PM1 and the pull-down driver NM1 are simultaneously turned on is inevitable during the sensing operations of the first and the second comparators. Therefore, the additional current consumption cannot be avoided.

SUMMARY OF THE INVENTION

It is, therefore, an object of the present invention to provide an internal voltage generator which can supply a stable internal voltage with less current consumption.

In accordance with an aspect of the present invention, there is provided an internal voltage generator, including: a pull-up driver to pull-up drive a supply terminal of an internal voltage; a pull-down driver to pull-down drive the supply terminal of the internal voltage; a pull-up driving control means to turn on the pull-up driver when a first feedback voltage corresponding to the internal voltage becomes lower than a reference voltage; and a pull-down driving control means to turn on the pull-down driver when a second feedback voltage becomes higher than the reference voltage, the second feedback voltage having a voltage level corresponding to that of the internal voltage and lower than that of the first feedback voltage.

In accordance with another aspect of the present invention, there is provided an internal voltage generator, including: a pull-up driver to pull-up drive a supply terminal of an internal voltage; a pull-down driver to pull-down drive the supply terminal of the internal voltage; a pull-up driving control means to turn on the pull-up driver when a first feedback voltage corresponding to the internal voltage is lower than a reference voltage; and a pull-down driving control means comprising: a test unit to generate selection signals; a feedback unit to transfer one selected from a plurality of voltage levels corresponding to the internal voltage as a second feedback voltage in response to the selection signals; and a control signal generating unit to turn on the pull-down driver when the second feedback voltage level is higher than that of the reference voltage.

In accordance with still another aspect of the present invention, there is provided an internal voltage generator, including: a pull-up driving control means for performing a pull-up operation when a first feedback voltage corresponding to the internal voltage is lower than a reference voltage; and a pull-down driving control means comprising: a test unit to generate selection signals; a feedback unit to transfer one selected from a plurality of voltage levels generated by dividing the internal voltage as a second feedback voltage in response to the selection signals when a driving off signal is disabled; and a control signal generating unit for performing a pull-down operation when a level of the second feedback voltage is higher than that of the reference voltage.

BRIEF DESCRIPTION OF THE DRAWINGS

The above and other objects and features of the present invention will become better understood with respect to the following description of the exemplary embodiments given in conjunction with the accompanying drawings, in which.

DETAILED DESCRIPTION OF THE INVENTION

An internal voltage generator in accordance with exemplary embodiments of the present invention will be described in detail with reference to the accompanying drawings.

Figure 1:
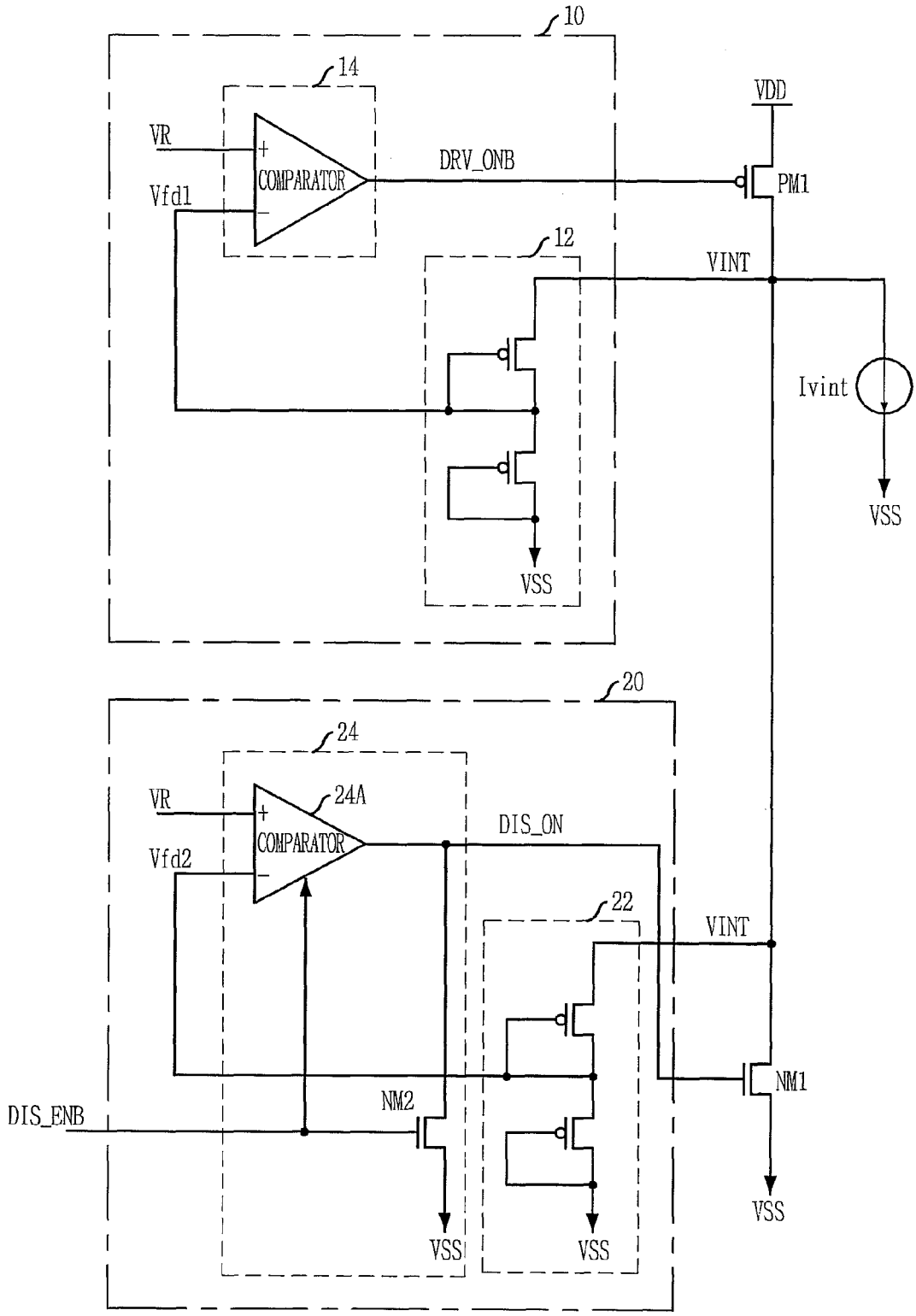
FIG. 1 (RELATED ART)
FIG. 1 is a circuit diagram of a typical internal voltage generator.
Figure 2:
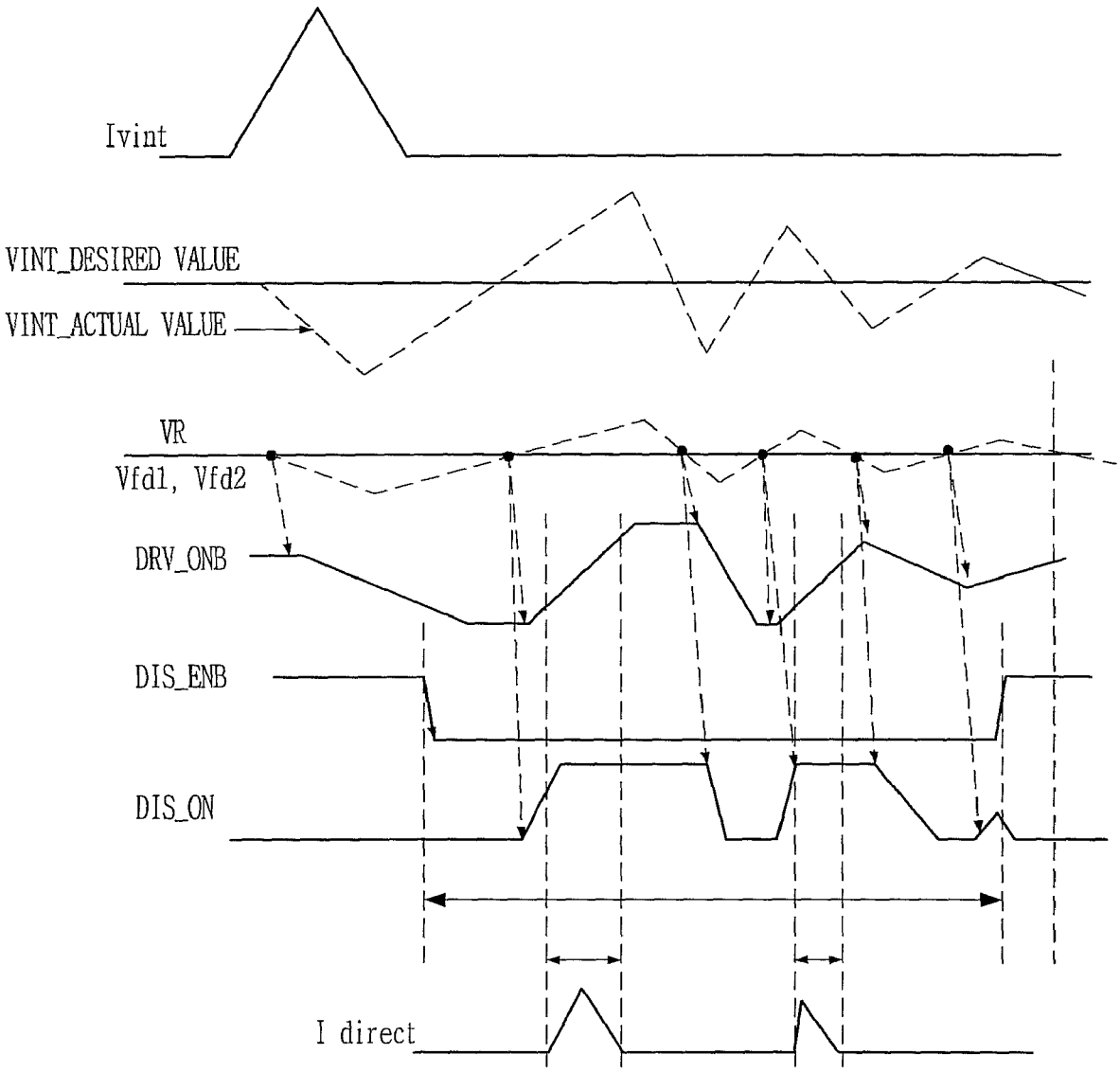
FIG. 2 (RELATED ART)
FIG. 2 is a waveform diagram of operations of the typical internal voltage generator shown in FIG. 1.
Figure 3:
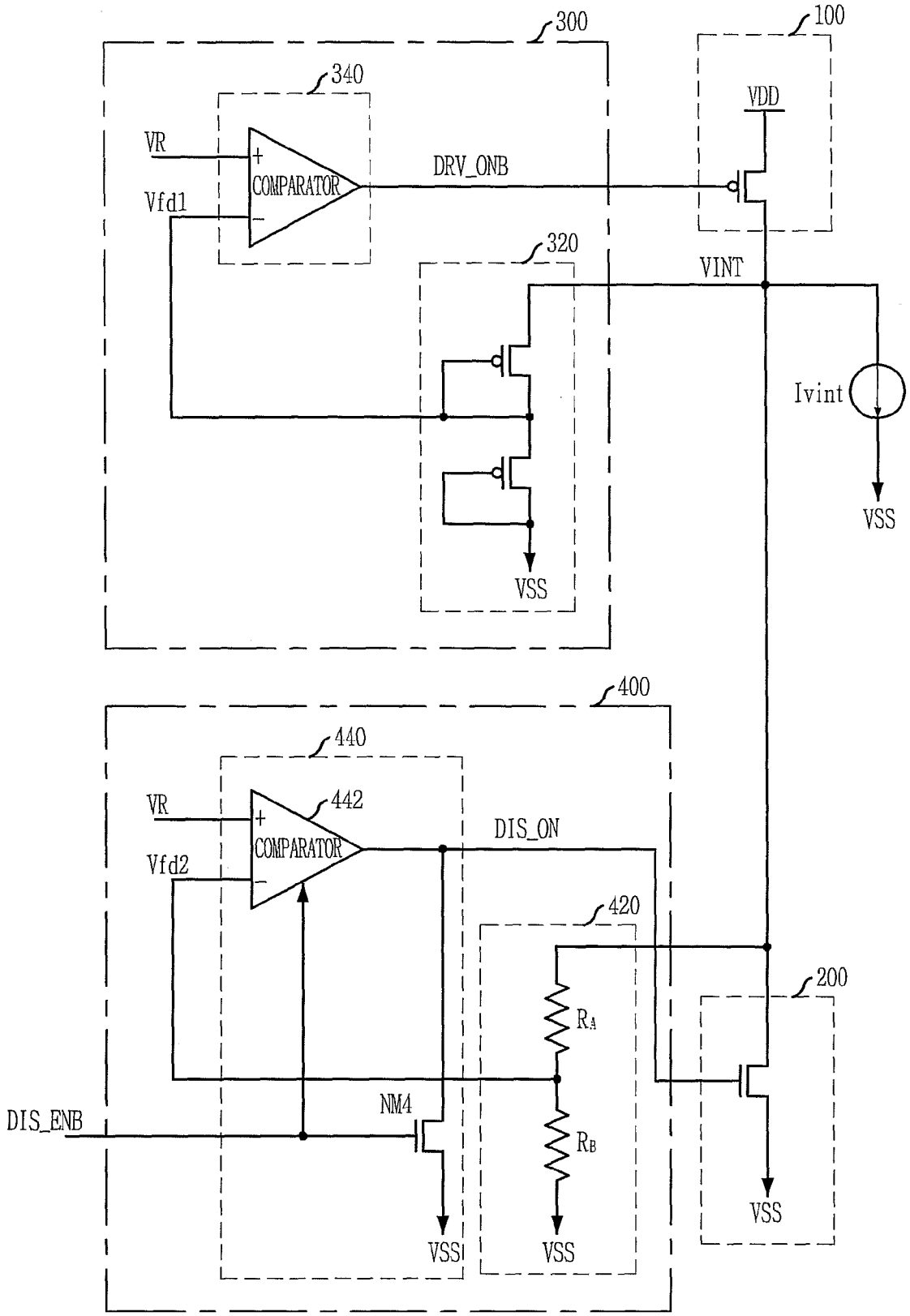
FIG. 3 is a circuit diagram of an internal voltage generator in accordance with a first embodiment of the present invention.

FIG. 3 is a circuit diagram of an internal voltage generator in accordance with a first embodiment of the present invention. The internal voltage generator includes a pull-up driver 100 for pull-up driving a supply terminal of an internal voltage VINT, a pull-down driver 200 for pull-down driving the supply terminal of the internal voltage VINT, a pull-up driving control unit 300 for turning on the pull-up driver 100 when a first feedback voltage Vfd1 corresponding to the internal voltage VINT becomes lower than a reference voltage VR, and a pull-down driving control unit 400 for turning on the pull-down driver 200 when a second feedback voltage Vfd2 becomes higher than the reference voltage VR, the second feedback voltage Vfd2 having a voltage level which corresponds to the internal voltage VINT and is lower than the first feedback voltage Vfd1.

The pull-up driving control unit 300 includes a first feedback unit 320 for generating the first feedback voltage Vfd1 having a uniform voltage level with respect to the level of the internal voltage VINT, and a first control signal generating unit 340 for generating a pull-up driving signal DRV_ONB by comparing the reference voltage VR and the first feedback voltage Vfd1. The first feedback voltage Vfd1 has an approximately half voltage level of the internal voltage VINT.

The first control signal generating unit 340 includes a first comparator receiving the first feedback voltage Vfd1 and the reference voltage VR as differential inputs. The first comparator enables the pull-up driving signal DRV_ONB into a logic level low (L) when the level of the first feedback voltage Vfd1 is lower than that of the reference voltage VR.

The pull-down driving control unit 400 includes a second feedback unit 420 for generating the second feedback voltage Vfd2 by using resistors of passive devices coupled in series between the supply terminal of the internal voltage VINT and a supply terminal of a ground voltage VSS, and a second control signal generating unit 440 for generating a pull-down driving signal DIS_ON by comparing the reference voltage VR and the second feedback voltage Vfd2 in response to a driving off signal DIS_ENB.

The second feedback unit 420 includes a first resistor $R_A$ and a second resistor $R_B$ coupled in series between the supply terminal of the internal voltage VINT and the supply terminal of the ground voltage VSS, and transfers a voltage caught on a common connection node of the first resistor $R_A$ and the second resistor $R_B$ to the second feedback voltage Vfd2.

The second feedback voltage Vfd2 is determined by a ratio of the first resistor $R_A$ and the sum of the first resistor $R_A$ and the second resistor $R_B$ as the following mathematical equation 1.

$$Vfd2=(R_B)/(R_A+R_B)\times VINT \quad \text{[Equation 1]}$$

Herein, $R_B$ is smaller than $R_A$. The second feedback voltage Vfd2 has a level smaller than an approximately half voltage level of the internal voltage VINT. Thus, the second feedback voltage Vfd2 obtains a voltage level lower than that of the first feedback voltage Vfd1.

The second control signal generating unit 440 includes a second comparator 442 and an off unit NM4. The second comparator 442 compares a voltage level difference between the second feedback voltage Vfd2 and the reference voltage VR when the driving off signal DIS_ENB is disabled. When the level of the second feedback voltage Vfd2 is higher than that of the reference voltage VR, the second comparator 442 enables the pull-down driving signal DIS_ON into a logic level high (H). The off unit NM4 disables the pull-down driving signal DIS_ON into a logic level L when the driving off signal DIS_ENB is enabled.

The off unit NM4 includes an NMOS transistor receiving the driving off signal DIS_ENB through its gate and having a drain-source channel between an output node of the second comparator 442 and the supply terminal of the ground voltage VSS.

For reference, the driving off signal DIS_ENB is disabled by becoming synchronized by a signal inducing a large consumption of the internal voltage VINT, e.g., active command ACT. The driving off signal DIS_ENB is enabled by becoming synchronized by a signal which does not induce a consumption of the internal voltage VINT, e.g., pre-charge command PCG.

The internal voltage generator consistent with this first embodiment uses the second feedback voltage Vfd2 lower than the first feedback voltage Vfd1. Thus, a direct current consumption caused by a pull-down driver and a pull-up driver being turned on simultaneously can be reduced.

Figure 4:
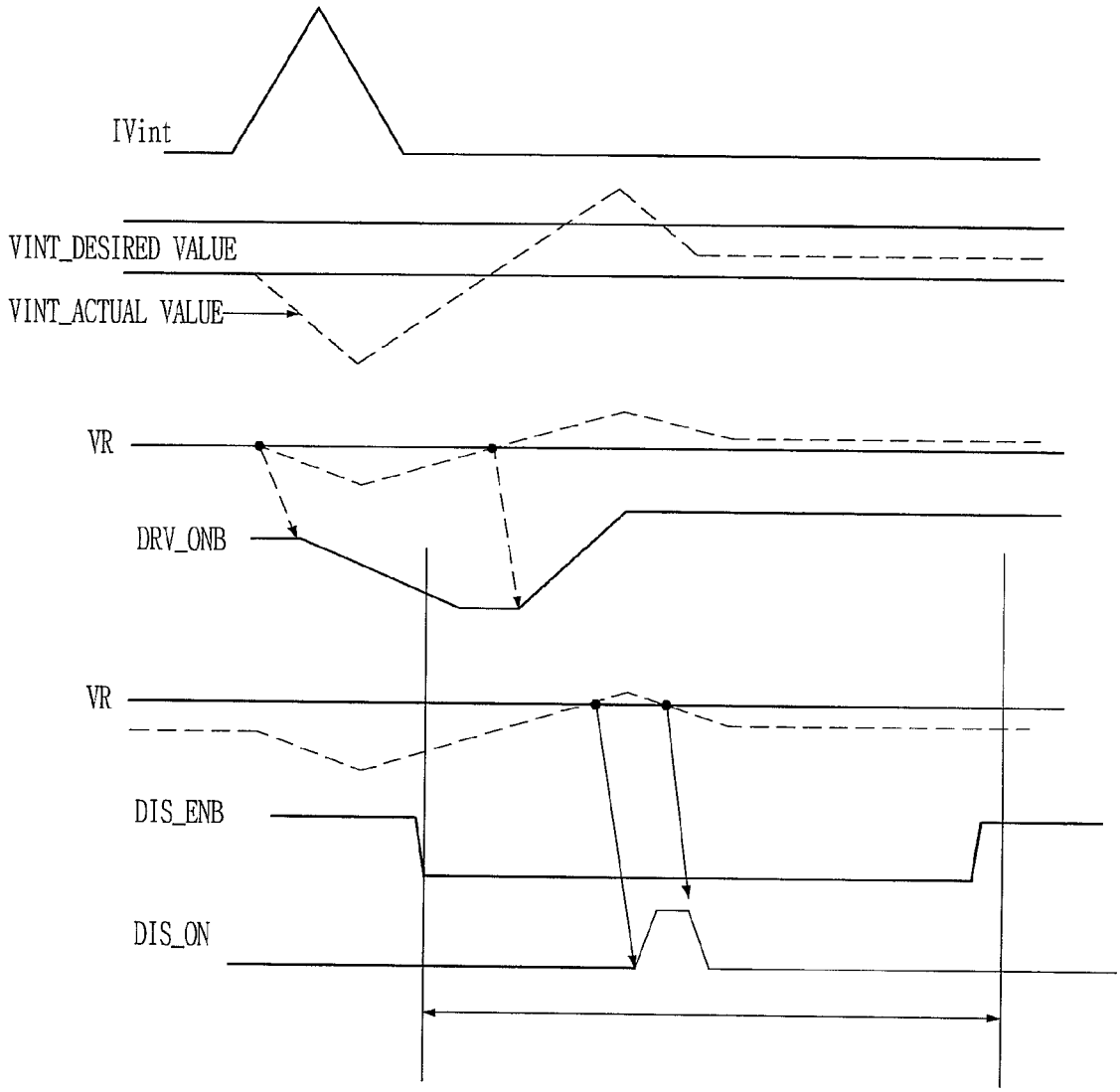
FIG. 4 is a waveform diagram of operations of the internal voltage generator shown in FIG. 3.

FIG. 4 is a waveform diagram of operations of the internal voltage generator shown in FIG. 3. An actual value of the internal voltage VINT_ACTUAL VALUE descends below a desired value VINT_DESIRED VALUE due to a consumption of the internal voltage VINT generated in the device. Thus, the level of the first feedback voltage Vfd1 generated by the first feedback unit 320 descends below the reference voltage VR. Consequently, the first comparator in the first control signal generating unit 340 enables the pull-up driving signal DRV_ONB into a logic level L. Thus, the pull-up driver 100 is enabled to supply the internal voltage VINT, ascending the actual value of the internal voltage VINT_ACTUAL VALUE. The first feedback voltage Vfd1 ascends above the reference voltage VR at the same time when the actual value of the internal voltage VINT_ACTUAL VALUE ascends above the desired value VINT_DESIRED VALUE. Thus, the first comparator transfers the pull-up driving signal DRV_ONB into a logic level H. The pull-up driver 100 operates for a predetermined period of time during the transition process before the pull-up driving signal DRV_ONB is determined as the logic level H. Thus, the actual value of the internal voltage VINT_ACTUAL VALUE ascends until the pull-up driver 100 is turned off.

When the level of the second feedback voltage Vfd2 ascends higher than that of the reference voltage VR, the comparator 442 enables the pull-down driving signal DIS_ON into a logic level H. However, an enabled period of the pull-up driving signal DRV_ONB and an enabled period of the pull-down driving signal DIS_ON do not overlap because the level of the second feedback voltage Vfd2 is lower than that of the first feedback voltage Vfd1.

The pull-down driver 200 enabled by the pull-up driving signal DIS_ON drives to pull down the supply terminal of the internal voltage VINT, and the pulling down continues until the level of the second feedback voltage Vfd2 becomes lower than that of the reference voltage VR.

The internal voltage generator consistent with the first embodiment avoids turning on the pull-up driver 100 and the pull-down driver 200 at the same time by descending the level of the second feedback voltage Vfd2, which is for limiting the ascending level of the internal voltage VINT, below the first feedback voltage Vfd1, which is for limiting the descending level of the internal voltage VINT. Consequently, a current consumption, which may be generated by a direct current flow caused by the drivers being turned on simultaneously, can be avoided.

Figure 5:
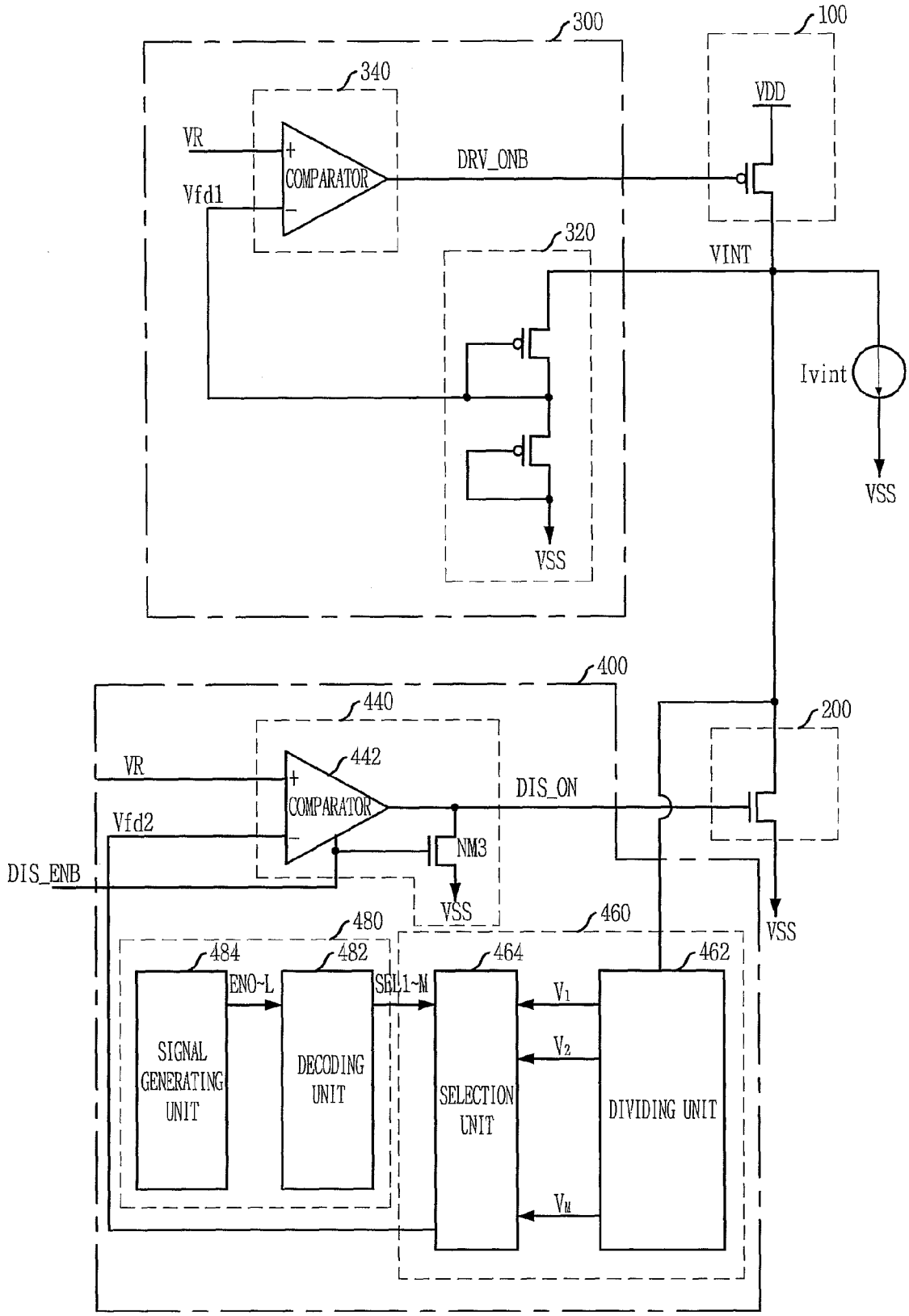
FIG. 5 is a circuit diagram of an internal voltage generator in accordance with a second embodiment of the present invention.

FIG. 5 is a circuit diagram of an internal voltage generator in accordance with a second embodiment of the present invention. The internal voltage generator includes a pull-up driver 100 for pull-up driving a supply terminal of an internal voltage VINT, a pull-down driver 200 for pull-down driving the supply terminal of the internal voltage VINT, a pull-up driving control unit 300 for turning on the pull-up driver 100 when a first feedback voltage Vfd1 corresponding to the internal voltage VINT becomes lower than a reference voltage VR, and a pull-down driving control unit 400. The pull-down driving control unit 400 includes a test unit 480 for generating selection signals (SEL1 to M), a second feedback unit 460 for transferring a voltage level selected from a plurality of voltage levels corresponding to the internal voltage VINT to a second feedback voltage Vfd2 in response to selection signals (SEL0 to M), and a second control signal generating unit 440 for turning on the pull-down driver 200 when a level of the second feedback voltage Vfd2 becomes higher than that of the reference voltage VR.

The second feedback unit 460 includes a dividing unit 462 for generating a plurality of signals having a uniform voltage level with respect to the internal voltage VINT, and a selection unit 464 for transferring a signal selected from the plurality of signals to the second feedback voltage Vfd2 in response to the selection signals (SEL1 to M).

The test unit 480 includes a signal generating unit 484 for generating test signals (ENO to L), and a decoding unit 482 for enabling a signal selected from the selection signals (SEL0 to M) by decoding the test signals (ENO to L).

The internal voltage generator consistent with the second embodiment further includes the second feedback unit 460 and the test unit 480 when compared to the internal voltage generator consistent with the first embodiment. Thus, the most effective voltage level of the second feedback voltage Vfd2 can be known, because a level of a feedback can be selected in the second embodiment. Because the internal voltage generator consistent with the second embodiment further includes only the test unit 480 and the second feedback unit 460, only these units are described in more detail hereinafter.

Figure 6:
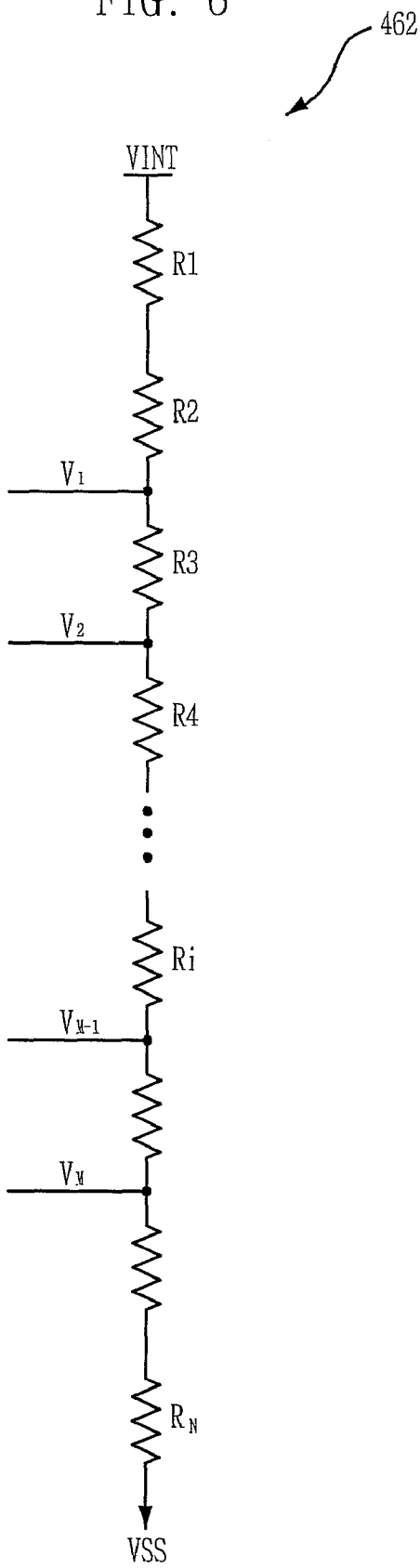
FIG. 6 is a circuit diagram of a dividing unit shown in FIG. 5.

FIG. 6 is a circuit diagram of the dividing unit 462 shown in FIG. 5. The dividing unit 462 includes a plurality of resistors of passive devices ($R_1$, $R_2$ . . . $R_N$) coupled in series between the supply terminals of the internal voltage VINT and a ground voltage VSS, and outputs each voltage caught on each common connection node. The dividing unit 462 divides the internal voltage VINT through the resistors of the passive devices ($R_1$, $R_2$ . . . $R_N$) coupled in series and outputs a plurality of output signals ($V_1$, $V_2$ . . . $V_{M-1}$, $V_M$).

Figure 7:
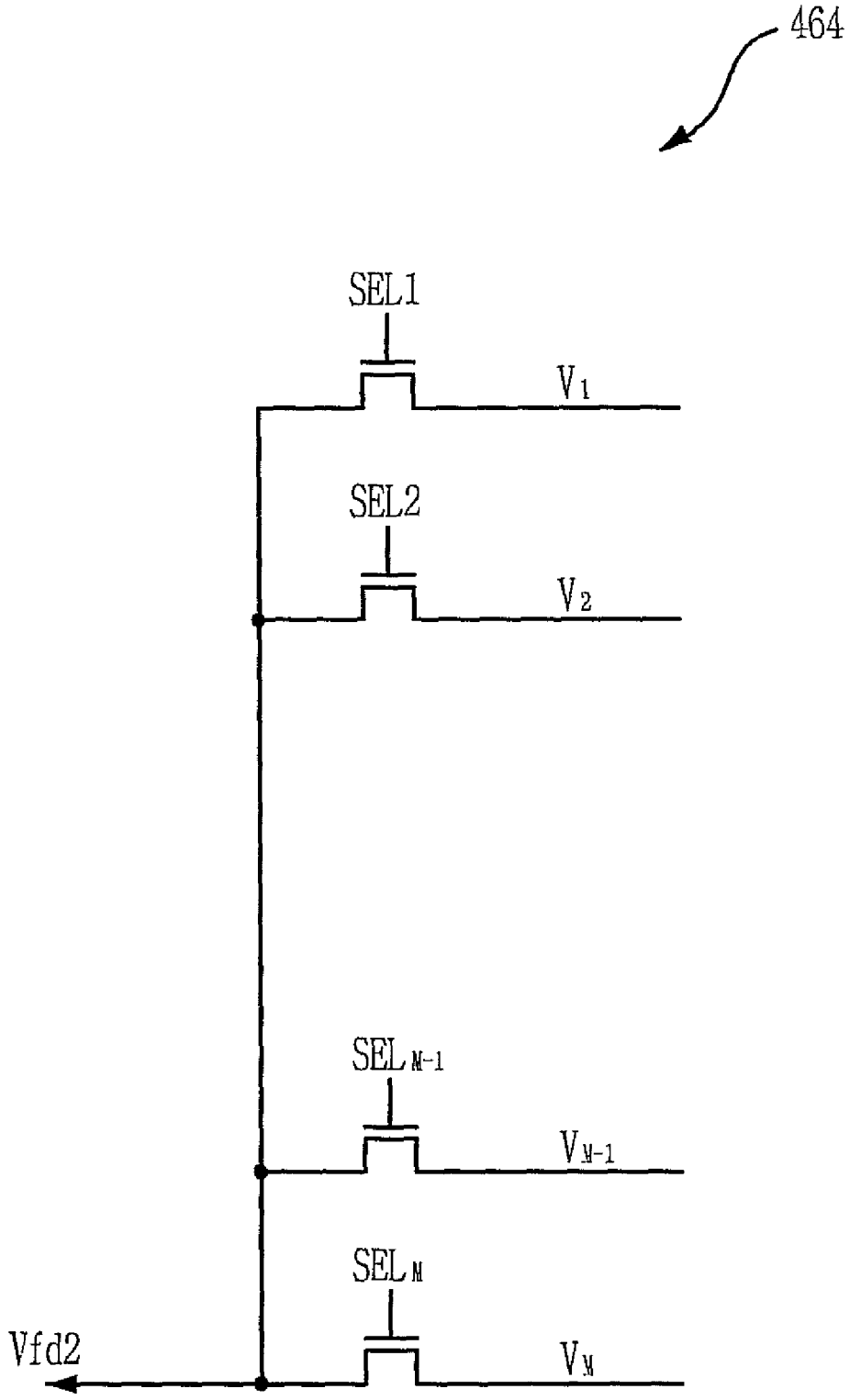
FIG. 7 is a circuit diagram of a selection unit shown in FIG. 5.

FIG. 7 is a circuit diagram of the selection unit 464 shown in FIG. 5. The selection unit 464 includes a plurality of switches for transferring an output signal selected from the output signals ($V_1$, $V_2$ . . . $V_{M-1}$, $V_M$) of the dividing unit 462 to the second feedback voltage Vfd2 in response to enablement of the corresponding selection signals (SEL1 to M).

For example, when a selection signal SEL2 is enabled, a switch is enabled, and a corresponding output signal $V_2$ of the driving unit 462 is outputted to the second feedback voltage Vfd2. A voltage level of the outputted second feedback voltage Vfd2 is represented as the mathematical equation 2 below, $$Vfd2=(R4+R5+\ldots+R_N)/(R1+R2+\ldots+R_N)\times VINT \qquad \text{[Equation 2]}$$

The voltage level of the second feedback voltage Vfd2, outputted by the second feedback unit 460 as above, varies according to the selection signals (SEL1 to M) supplied.

Figure 8:
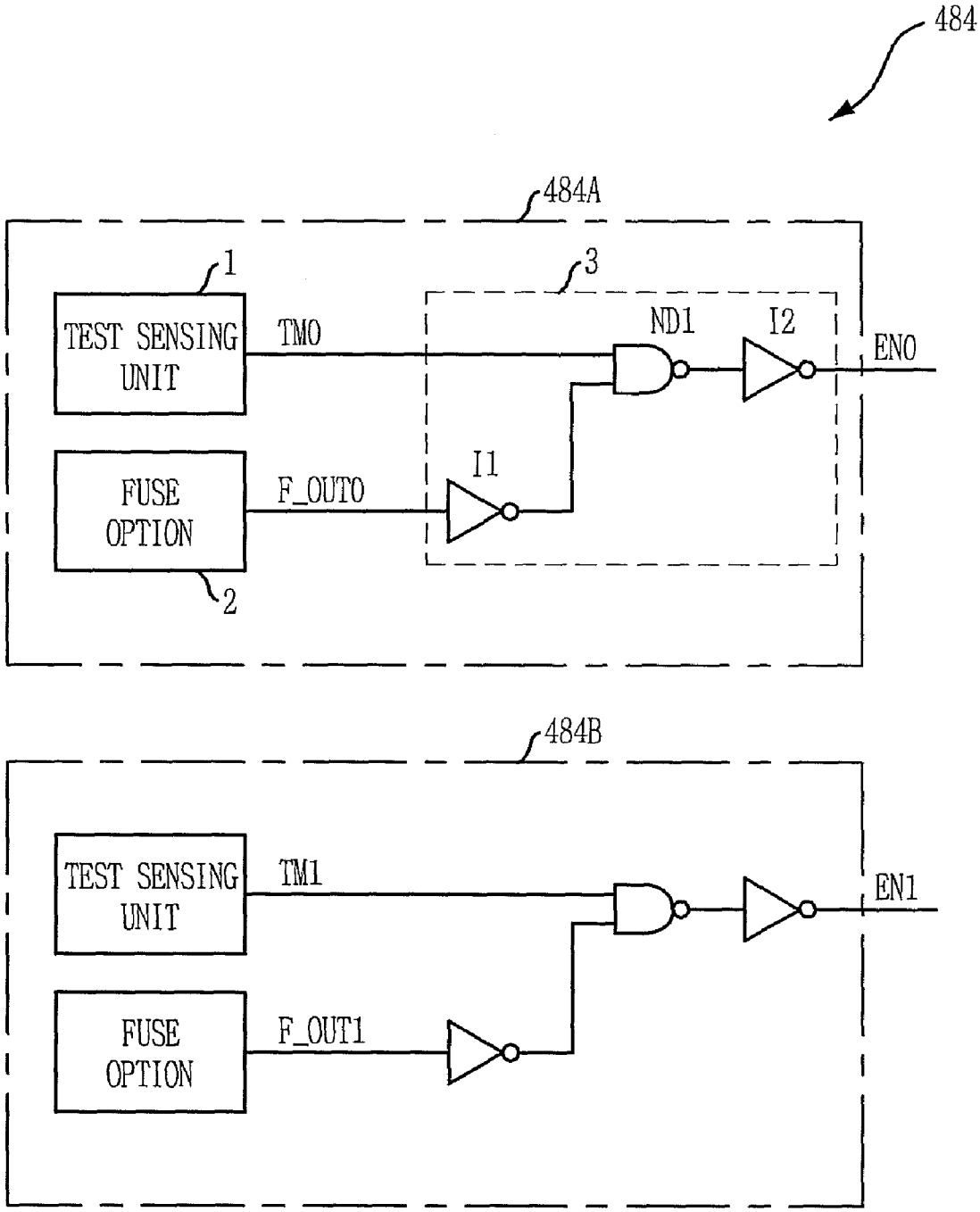
FIG. 8 is a circuit diagram of a signal generating unit shown in FIG. 5.

FIG. 8 is a circuit diagram of the signal generating unit 484 shown in FIG. 5. The signal generating unit 484 includes a plurality of signal generating units, i.e., a first signal generating unit 484A and a second signal generating unit 484B, for generating the corresponding test signals (ENO to L). For instance, the first signal generating unit 484A includes a first test sensing unit 1 for sensing a test mode and an input of a corresponding test signal through an input signal and outputting a first source signal TM0, a first fuse option unit 2 for outputting a first fuse signal F_OUT0, and a first output unit 3 for generating a first test signal ENO by receiving output signals of the first fuse option unit 2 and the first test sensing unit 1. The second signal generating unit 484B includes a second test sensing unit for sensing a test mode and an input of a corresponding test signal through an input signal and outputting a second source signal TM1, a second fuse option unit for outputting a second fuse signal F_OUT1, and a second output unit for generating a second test signal EN1 by receiving output signals of the second fuse option unit and the second test sensing unit.

The output unit 3 includes an inverter I1 for inverting the output signal of the fuse option unit 2, a NAND gate ND1 receiving an output signal of the inverter I1 and the output signal of the test sensing unit 1 as inputs, and another inverter I2 for outputting the first test signal ENO by inverting an output signal of the NAND gate ND1.

The first signal generating unit 484A senses an address inputted in a test mode and enables the corresponding test signal ENO, or enables the corresponding test signal ENO regardless of inputs when the fuse option unit 2 is set up.

Consistent with the second embodiment, operations of the internal voltage generator shown in FIGS. 5 to 8, especially a process of selecting the second feedback voltage Vfd2, are described in more detail hereinafter. The test unit 480 enables the corresponding test signals (ENO to L) through an inputted address in a test mode. Thus, the output signals ($V_1$, $V_2$ . . . $V_{M-1}$, $V_M$), outputted with a uniform voltage level with respect to the internal voltage VINT by the dividing unit 462, corresponding to the corresponding selection signals (SEL1 to M) are outputted to the second feedback voltage Vfd2 by the selection unit 464.

When the voltage level of the second feedback voltage Vfd2 selected as above ascends higher than that of the reference voltage VR, the second comparator 442 enables the pull-down driving signal DIS_ON to enable the pull-down driver 200.

As described above, various voltage levels of the second feedback voltage Vfd2 are selected in the test mode, and resultant drives and current consumptions of the internal voltage generator can be tested. The second feedback voltage Vfd2 having a high efficiency can be set up, and the fuse option unit 2 can be set up in a manner to always output the corresponding output signals of the dividing unit 462 to the second feedback voltage Vfd2.

Thus, the internal voltage generator consistent with the second embodiment can select a feedback voltage having a low current consumption through the test mode without a re-designing of the chip.

Meanwhile, if the dividing unit 462 including the plurality of resistors of the passive devices coupled in series is employed as the internal voltage generator consistent with the second embodiment, a static current may increase.

Figure 9:
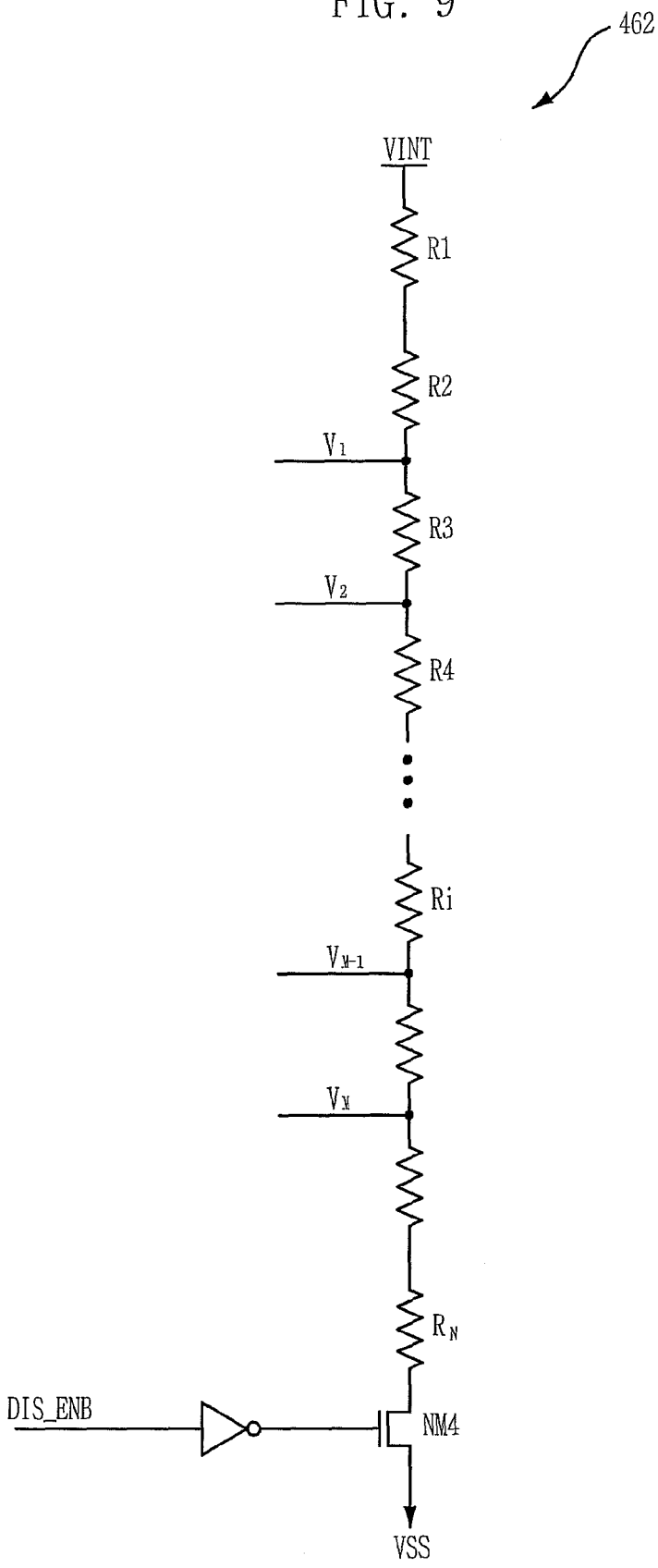
FIG. 9 is a circuit diagram of the dividing unit shown in FIG. 5 in accordance with another embodiment of the present invention.

Referring to FIG. 9, the static current can further be decreased by including a switch NM4, which is driven by the driving off signal DIS_ENB between a resistor $R_N$ and the supply terminal of the ground voltage VSS in the dividing unit 462. Although only the dividing unit 462 of the internal voltage generator consistent with the second embodiment is shown, the switch for reducing the static current can be applied to the second feedback unit 420 consistent with the first embodiment of this invention and gain substantially the same effects of reduced static current.

In accordance with the embodiments of the present invention, the current consumption generated by the pull-up driver and the pull-down driver being turned on at the same time can be reduced by varying the voltage levels of the first and the second feedback voltages for controlling the pull-up and pull-down drives of the internal voltage. Also, the voltage level of the feedback voltage having the least current consumption can be tested without re-designing the chip. Thus, a stable internal voltage can be provided.

While the present invention has been described with respect to certain specific embodiments, it will be apparent to those skilled in the art that various changes and modifications may be made without departing from the spirit and scope of the invention as defined in the following claims.

What is claimed is:

1. An internal voltage generator, comprising:

a pull-up driver to pull-up drive a supply terminal of an internal voltage;

a pull-down driver to pull-down drive the supply terminal of the internal voltage;

a pull-up driving control means to turn on the pull-up driver when a first feedback voltage corresponding to the internal voltage is lower than a reference voltage; and a pull-down driving control means including:

a test unit to generate selection signals, the test unit including a signal generating unit to generate a plurality of test signals and a decoding unit to enable one of the selection signals by decoding the plurality of test signals, the signal generating unit including first to $N^{th}$ signal generating units to either enable a corresponding test signal by sensing an address input in a test mode, or to enable the corresponding test signal regardless of inputs when a fuse option is set up;

a feedback unit to transfer a voltage level selected from a plurality of voltage levels corresponding to the internal voltage to a second feedback voltage in response to the selection signals; and a control signal generating unit to turn on the pull-down driver when the second feedback voltage level is higher than that of the reference voltage.

2. The internal voltage generator of claim 1 wherein each of the first to $N^{th}$ signal generating units comprises:

a test sensing unit to sense the test mode and an input of a corresponding test signal through the address received from the test mode;

a fuse option unit; and an output unit to generate the corresponding test signal by receiving output signals of the fuse option unit and the test sensing unit.

3. The internal voltage generator of claim 2, wherein the output unit of each of the first to $N^{th}$ signal generating units comprises:

a first inverter to invert the output signal of the fuse option unit;

a NAND gate to receive an output signal of the first inverter and the output signal of the test sensing unit as inputs; and a second inverter to invert an output signal of the NAND gate to output the inverted output signal of the NAND gate as the corresponding test signal.

4. The internal voltage generator of claim 3, wherein the feedback unit comprises:

a dividing unit to generate a plurality of signals having the plurality of voltage levels with respect to the internal voltage; and a selection unit to transfer one of the plurality of signals generated by the dividing unit to the second feedback voltage in response to the selection signals.

5. The internal voltage generator of claim 4, wherein the dividing unit comprises a plurality of passive devices coupled in series between the supply terminal of the internal voltage and a supply terminal of a ground voltage, the dividing unit outputting a voltage of each common connection node.

6. The internal voltage generator of claim 5, wherein the selection unit comprises a plurality of switches to transfer a corresponding signal of the plurality of signals generated by the dividing unit to the second feedback voltage in response to enablement of a corresponding selection signal.

7. The internal voltage generator of claim 6, wherein the first feedback voltage has an approximately half voltage level of the internal voltage level.

8. An internal voltage generator, comprising:

a pull-up driving control circuit configured to control a pull-up driver to perform a pull-up operation when a first feedback voltage corresponding to an internal voltage is lower than a reference voltage; and a pull-down driving control circuit comprising:

a test unit to generate selection signals;

a feedback unit to transfer one voltage level selected from a plurality of voltage levels generated by dividing the internal voltage as a second feedback voltage in response to the selection signals when a driving off signal is disabled; and a control signal generating unit configured to control a pull-down driver to perform a pull-down operation when a level of the second feedback voltage is higher than that of the reference voltage, wherein the driving off signal is disabled by becoming synchronized by a command including an active command which causes a high level of internal voltage power consumption, and enabled by becoming synchronized by a command including a pre-charge command which causes a substantially low level of internal voltage power consumption.

9. The internal voltage generator of claim 8, wherein the pull-up driver performs the pull-up operation on a supply terminal of the internal voltage; and the pull-down driver performs the pull-down operation on the supply terminal of the internal voltage.

10. The internal voltage generator of claim 9, wherein the feedback unit comprises:

a dividing unit to generate a plurality of signals having the plurality of voltage levels with respect to the internal voltage when the driving off signal is disabled; and a selection unit to transfer one of the plurality of signals generated by the dividing unit to the second feedback voltage in response to the selection signals.

11. The internal voltage generator of claim 10, wherein the dividing unit comprises:

a first resistor coupled to the supply terminal of the internal voltage by an end;

N number of resistors coupled to the other end of the first resistor in series; and a switch to couple an end of the last resistor from the N number of resistors and a supply terminal of a ground voltage in response to the driving off signal, the dividing unit outputting a voltage of each common connection node of the resistors.

12. The internal voltage generator of claim 11, wherein the test unit comprises:

a signal generating unit to generate a plurality of test signals; and a decoding unit to enable a selection signal by decoding the plurality of test signals.

13. The internal voltage generator of claim 12, wherein the signal generating unit comprises first to $N^{th}$ signal generating units to either enable a corresponding test signal by sensing an address input in a test mode, or to enable the corresponding test signal regardless of inputs when a fuse option is set up.

14. The internal voltage generator of claim 13, wherein each of the first to $N^{th}$ signal generating units comprises:

a test sensing unit to sense the test mode and an input of a corresponding test signal through the address received from the test mode;

a fuse option unit; and an output unit to generate the corresponding test signal by receiving output signals of the fuse option unit and the test sensing unit.

15. The internal voltage generator of claim 14, wherein the output unit of each of the first to $N^{th}$ signal generating units comprises:

a first inverter to invert the output signal of the fuse option unit;

a NAND gate to receive an output signal of the first inverter and the output signal of the test sensing unit as inputs; and a second inverter to invert an output signal of the NAND gate to output the inverted output signal of the NAND gate as the corresponding test signal.

16. The internal voltage generator of claim 15, wherein the first feedback voltage has an approximately half voltage level of the internal voltage level.

* * * * *